US007469676B2

(12) United States Patent
Weiss et al.

(10) Patent No.: US 7,469,676 B2
(45) Date of Patent: Dec. 30, 2008

(54) METHOD AND DEVICE FOR DETERMINING A PHASE OF AN INTERNAL COMBUSTION ENGINE

(75) Inventors: Frank Weiss, Pentling/Grasslfing (DE); Hong Zhang, Tegemheim (DE)

(73) Assignee: Siemens Aktiengesellschaft, Munich (DE)

( * ) Notice: Subject to any disclaimer, the term of this patent is extended or adjusted under 35 U.S.C. 154(b) by 246 days.

(21) Appl. No.: 10/589,793

(22) PCT Filed: Nov. 26, 2005

(86) PCT No.: PCT/EP2005/056284

§ 371 (c)(1),
(2), (4) Date: Aug. 17, 2006

(87) PCT Pub. No.: WO2006/069871

PCT Pub. Date: Jul. 6, 2006

(65) Prior Publication Data

US 2007/0233356 A1 Oct. 4, 2007

(30) Foreign Application Priority Data

Dec. 23, 2004 (DE) ..... 10 2004 062 406

(51) Int. Cl.
*F02D 13/04* (2006.01)
*B60T 7/12* (2006.01)

(52) U.S. Cl. ..... 123/321; 123/90.15; 123/345; 701/103

(58) Field of Classification Search ..... 123/90.15, 123/90.16, 90.17, 90.18, 321, 345, 346, 347, 123/348; 701/103, 105
See application file for complete search history.

(56) References Cited

U.S. PATENT DOCUMENTS 5,495,830 A 3/1996 Wu (Continued)

FOREIGN PATENT DOCUMENTS

DE 196 38 010 A1 3/1998

(Continued)

OTHER PUBLICATIONS

Richard Van Basshuysen, Fred Schäfer; "Handbuch Verbrennungsmotor"; First edition; Apr. 2002; pp. 348-361; Chapter 10.4, Vieweg. Germany.

*Primary Examiner*—John T Kwon
(74) *Attorney, Agent, or Firm*—Bell, Boyd & Lloyd LLP

(57) ABSTRACT

The invention concerns a method and a device for determining an internal combustion engine phase. Said device comprises an intake zone, an exhaust zone, at least one camshaft which acts on the gas exchanging valves and whereof the phase can be adjusted relative to that of a crankshaft by means of a phase adjusting device, and at least one sensor whereof the measurement signal enables a specific phase to be determined. The phase adjusting device is controlled in accordance with phase adjustment of the camshaft until detection of a gas reflux from the exhaust zone to the intake zone. A correction value is determined based on the associated specific phase and on a specific allocated phase. In the next operating mode, the respectively specific phase is corrected based on the correction value.

14 Claims, 4 Drawing Sheets

U.S. PATENT DOCUMENTS

| | | | | |
|---|---|---|---|---|
| 6,513,488 | B2 * | 2/2003 | Enoki et al. | 123/305 |
| 6,814,052 | B2 * | 11/2004 | Weiss et al. | 123/350 |
| 6,948,358 | B2 * | 9/2005 | Weiss et al. | 73/119 R |
| 7,104,248 | B2 * | 9/2006 | Weiss | 123/305 |
| 2006/0196479 | A1 * | 9/2006 | Weiss et al. | 123/478 |
| 2007/0051343 | A1 * | 3/2007 | Weiss et al. | 123/442 |

FOREIGN PATENT DOCUMENTS

| | | | |
|---|---|---|---|
| JP | 2004108262 | A | 4/2004 |

* cited by examiner

METHOD AND DEVICE FOR DETERMINING A PHASE OF AN INTERNAL COMBUSTION ENGINE

CROSS REFERENCE TO RELATED APPLICATIONS

This application is the US National Stage of International Application No. PCT/EP2005/056284, filed Nov. 28, 2005 and claims the benefit thereof. The International Application claims the benefits of German Patent application No. 10 2004 062 406.2 filed Dec. 23, 2004. All of the applications are incorporated by reference herein in their entirety.

FIELD OF THE INVENTION

Method and device for determining a phase of an internal combustion engine with an intake zone, an exhaust gas zone and at least one camshaft, which acts on gas exchange valves and whose phase in respect of a crankshaft can be adjusted by means of a phase adjusting device.

BACKGROUND OF THE INVENTION

The requirements relating to the output and efficiency of internal combustion engines are becoming increasingly stringent. At the same time strict legal provisions require pollutant emissions to be kept at low levels. To this end it is known that internal combustion engines can be fitted with a phase adjusting device, which can be used to modify a phase between a crankshaft and a camshaft of the internal combustion engine during operation. The respective start and end of the opening or closing of the gas inlet and/or gas outlet valve can thus be modified in relation to a reference point on the crankshaft. This allows the level of gas in a cylinder to be modified; in particular it is possible for exhaust gas to be fed back internally into the respective cylinder.

SUMMARY OF THE INVENTION

The object of the invention is to create a method and device for determining a phase of an internal combustion engine, allowing precise determination of the phase.

The object is achieved by the features of the independent claims. Advantageous embodiments of the invention are characterized in the subclaims.

The invention is characterized by a method and a corresponding device for determining a phase of an internal combustion engine with an intake zone, an exhaust gas zone and at least one camshaft, which acts on gas exchange valves and whose phase in respect of a crankshaft can be adjusted by means of a phase adjusting device, with at least one sensor, as a function of whose measurement signal a determined phase is determined. The phase adjusting device is activated to adjust the phase of the camshaft, until a reflux of gas from the outlet zone into the intake zone is identified. A correction value is then determined as a function of the determined phase then assigned and a predetermined default phase. The respectively determined phase is then corrected as a function of the correction value during subsequent operation.

The phase is representative of an angle between a reference mark on both the respective camshaft and the crankshaft in a predetermined angle position of the crankshaft for example, which can for example be a top dead center during ignition of a piston of a cylinder but can also be any other predetermined angle position of the crankshaft. The sensor(s), as a function of whose measurement signal the determined phase is determined, is/are frequently incremental sensors, such as Hall sensors, with a toothed wheel as the primary element. Tolerances in the arrangement of the sensor(s), wear and/or aging of the adjusting devices result in an inaccurate or modified assignment of the measurement signal(s) of the sensor(s) and thus in errors in the determined phase.

By adjusting the phase adjusting device in an appropriate manner, it is possible to achieve an operating point of the internal combustion engine, at which there is a reflux of gas from the outlet zone into the intake zone. Reflux of gas means that gas in the outlet zone flows back from the outlet zone into the intake zone during the operating cycle of the internal combustion engine.

The invention hereby utilizes the knowledge that the phase, during which said reflux starts to occur, is known for the respective internal combustion engine or internal combustion engine type. It is thus possible to assign a correct phase, the default phase, on identification of the reflux. A correction value can then be determined as a function of the default phase and the phase determined when the reflux of gas from the outlet zone into the intake zone is identified and it is thus possible in subsequent operation, during optionally different activation of the phase adjusting device, to correct the phase then determined in each instance as a function of the correction value. This then allows very precise control of the internal combustion engine.

According to one advantageous embodiment of the invention, the reflux of gas from the outlet zone into the intake zone is identified as a function of an intake pipe pressure. This has the advantage that an intake pipe pressure sensor, which is frequently present in any case, can easily be used to identify the reflux of gas from the outlet zone into the intake zone.

In this context it is advantageous, if the reflux from the outlet zone into the intake zone is identified, when the intake pipe pressure exceeds a predeterminable intake pipe threshold value under predetermined operating conditions. This allows the reflux to be identified particularly easily. The predetermined operating conditions are preferably predetermined such that the intake pipe pressure before and during the reflux of gas can be determined sufficiently precisely and preferably does not change significantly without reflux. It can thus be advantageous, if the predetermined operating conditions for example include a stationary operating state of the internal combustion engine.

According to a further advantageous embodiment of the invention, the reflux from the outlet zone into the intake zone is identified, when an amplitude of a pulsation of the intake pipe pressure exceeds a predeterminable pulsation threshold value. The pulsation is an oscillation of the intake pipe pressure with a frequency, which is a function of the rotational speed and number of the cylinders. This procedure is based on the knowledge that such a pulsation occurs during reflux and the reflux can thus be identified particularly precisely in this manner.

According to a further advantageous embodiment of the invention, the reflux of gas from the outlet zone into the intake zone is identified as a function of a temperature of the gas in the intake zone. This is based on the knowledge that the temperature of the gas in the intake zone increases due to hot reflux gases. It is thus possible to use a temperature sensor that is optionally present in any case for other purposes in the intake zone to identify the reflux of gas from the outlet zone into the intake zone.

According to a further advantageous embodiment of the invention, the reflux from the outlet zone into the intake zone is identified, when the temperature of the gas in the intake zone exceeds a predeterminable temperature threshold value.

The reflux can thus be determined particularly easily. Particularly early identification is thus possible, without a large quantity of exhaust gas necessarily having to flow back into the intake zone.

According to a further advantageous embodiment of the invention, the reflux of gas from the outlet zone into the intake zone is identified as a function of a temperature of the gas in the outlet zone. The reflux is identified, when, during an operating state of the internal combustion engine, the detected temperature changes from a value, which is representative of the absence of exhaust gases, to a temperature, which is representative of the presence of exhaust gases, without fuel being fed in.

According to a further advantageous embodiment of the invention, the reflux of the gas from the outlet zone into the intake zone is identified when the temperature of the gas in the outlet zone exceeds a predeterminable further temperature threshold value.

According to a further advantageous embodiment of the invention, a gas type sensor is assigned to the internal combustion engine in the outlet zone, whose measurement signal is representative of the absence or presence of exhaust gases in the region of the gas type sensor. The reflux is identified, when, during an operating state of the internal combustion engine, the measurement signal of the gas type sensor changes from a measurement signal value, which is representative of the absence of exhaust gases, to a measurement signal value, which is representative of the presence of exhaust gases, without fuel being fed in. The gas type sensor can for example be a lambda probe, even a two-position or linear lambda probe. Such a gas type sensor, i.e. in particular a lambda probe, is in any case present in internal combustion engines for lambda regulation and can thus easily be used for the purposes of identifying the reflux of gas from the outlet zone into the intake zone.

BRIEF DESCRIPTION OF THE DRAWINGS

Exemplary embodiments of the invention are described below with reference to the schematic drawings, in which.

Elements with the same structure or function are shown with the same reference characters in all the figures.

DETAILED DESCRIPTION OF THE INVENTION

Figure 1:
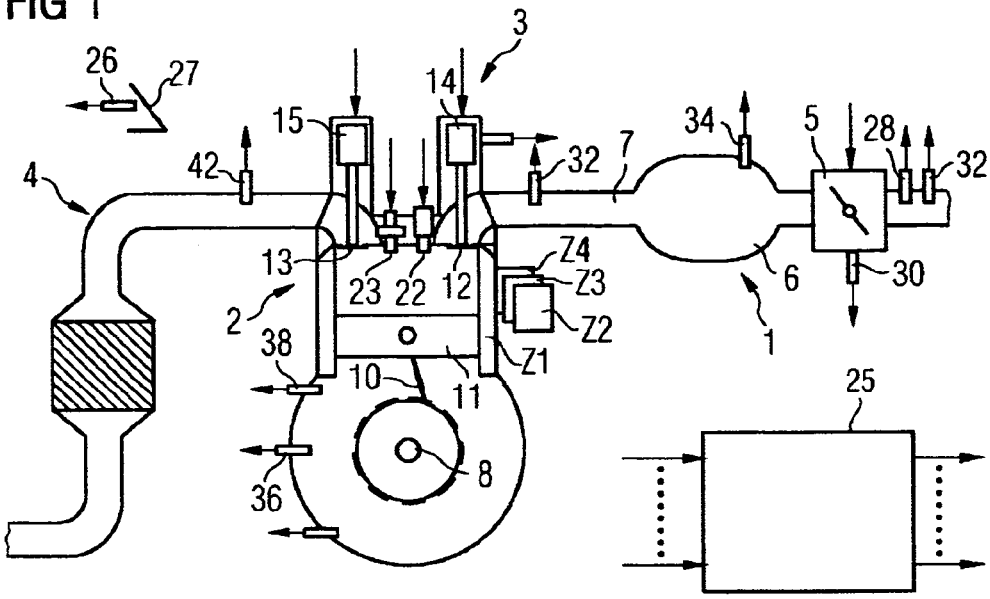
FIG. 1 shows an internal combustion engine with a control device.

An internal combustion engine (FIG. 1) comprises an intake zone 1, an engine block 2, a cylinder head 3 and an outlet zone 4. The intake zone 1 preferably comprises a throttle valve 5, also a manifold 6 and an intake pipe 7, which leads to a cylinder Z1 via an inlet channel into the engine block 2. The engine block 2 also comprises a crankshaft 8, which is coupled via a connecting rod 10 to the pistons 11 of the cylinder Z1.

The cylinder head 3 comprises a valve drive with gas exchange valves, which are gas inlet valves 12 and gas outlet valves 13, and valve drives 14, 15 assigned thereto.

Figure 2:
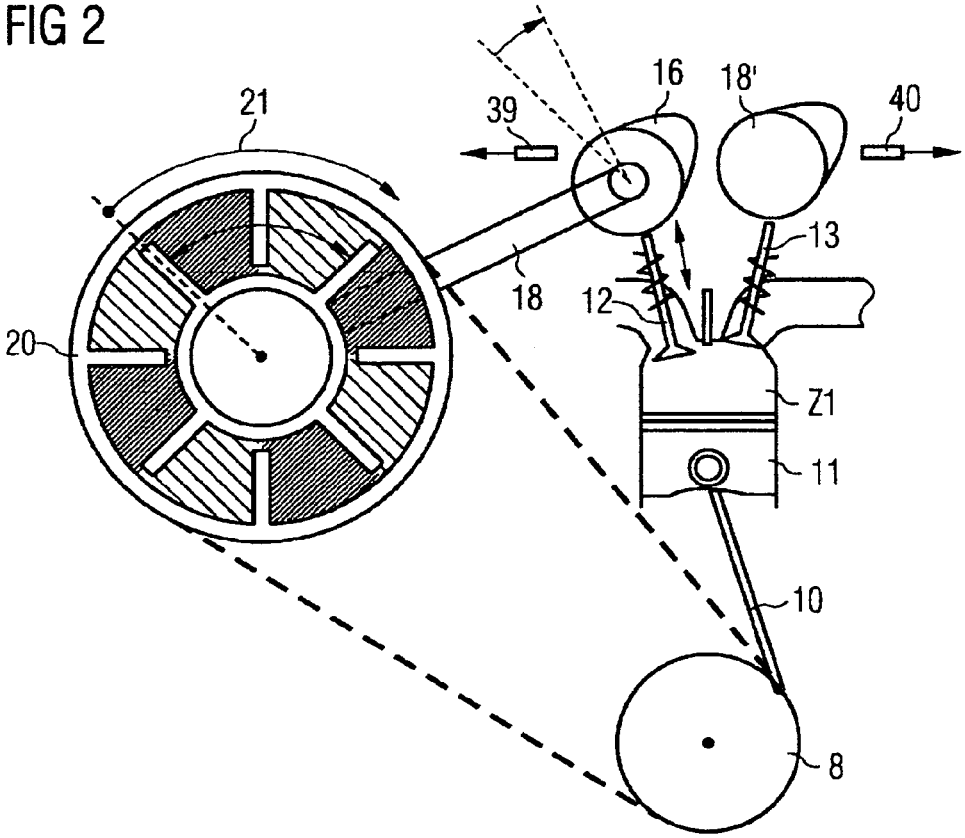
FIG. 2 shows a further view of parts of the internal combustion engine according to FIG. 1.

A camshaft 18 is provided, comprising a cam 16, which acts on the gas inlet valve 12. A phase adjusting device 20 (FIG. 2) is provided, which can be used to adjust a phase between the crankshaft 8 and the camshaft 18. This phase adjustment can for example be effected by increasing a hydraulic pressure in high-pressure chambers of the phase adjusting device 20 or reducing the corresponding pressure, depending on the direction in which the phase is to be adjusted. A possible phase adjustment region is marked with an arrow 21.

At least two camshafts 18, 18' are preferably provided, a first camshaft 18 being assigned to the respective gas inlet valves 12 and a second camshaft 18' being assigned to the respective gas outlet valves 13. In a simple embodiment the second camshaft 18' in particular can be coupled mechanically to the crankshaft 8 with a fixed phase in respect of said crankshaft 8. It can however also be coupled to the crankshaft 8 via a corresponding phase adjusting device. In this instance the phase of the second camshaft 18' can also be modified.

By varying the phase between the crankshaft 8 and the camshaft 18 it is possible to modify the valve lap of the gas inlet valve 12 and the gas outlet valve 13, in other words the crankshaft angle range, during which both an inlet and an outlet of the cylinder Z1 are enabled. The phase adjusting device 20 and also the valve lift adjusting device 19 can also be configured in any other manner known to the person skilled in the art.

The cylinder head 3 also comprises an injection valve 22 and a spark plug 23. The injection valve 22 can alternatively also be located in the intake pipe 7.

A control device 25 is provided, to which sensors are assigned, which detect different measured variables and determine the value of the measured variable in each instance. The control device 25 determines manipulated variables as a function of at least one of the measured variables and these are then converted to one or more actuating signals to control the final control elements by means of corresponding actuators. The control device 25 can also be referred to as a device for controlling the internal combustion engine or even as a device for determining the phase of the internal combustion engine.

The sensors are a pedal position sensor 26, which detects the position of an accelerator pedal 27, an air mass sensor 28, which detects an air mass flow upstream of the throttle valve 5, a throttle valve position sensor 30, which detects the degree to which a throttle valve is open, a first temperature sensor 32, which detects a temperature T_IM of the gas in the intake zone 1, an intake pipe pressure sensor 34, which detects an intake pipe pressure P_IM in the manifold 6, a crankshaft angle sensor 36, which detects a crankshaft angle CRK, to which a rotational speed N is then assigned. A camshaft angle sensor 39 is also provided, which detects a camshaft angle CAM. If two camshafts are present, a camshaft angle sensor 39, 40 is preferably assigned to each camshaft. A gas type sensor, in particular a lambda probe 42, is also provided, which detects the oxygen content of the gas in the outlet zone and whose measurement signal is characteristic of the air/fuel ratio in the cylinder Z1, when fuel combustion takes place in the cylinder. A specific sensor can also be provided to detect the determined phase PH_E. The at least one sensor for detecting the determined phase PH_E can however also preferably be provided by the camshaft angle sensor 39, 40 and/or the crankshaft angle sensor 36.

Depending on the embodiment of the invention, any subset of the sensors mentioned can be present or additional sensors may also be present.

The final control elements are for example the throttle valve 5, the gas inlet and gas outlet valves 12, 13, the phase adjusting device 20, the injection valve 22 or the spark plug 23.

As well as the cylinder Z1, further cylinders Z2 to Z4 are preferably also provided, to which corresponding final control elements and optionally sensors are also assigned.

Figure 3:
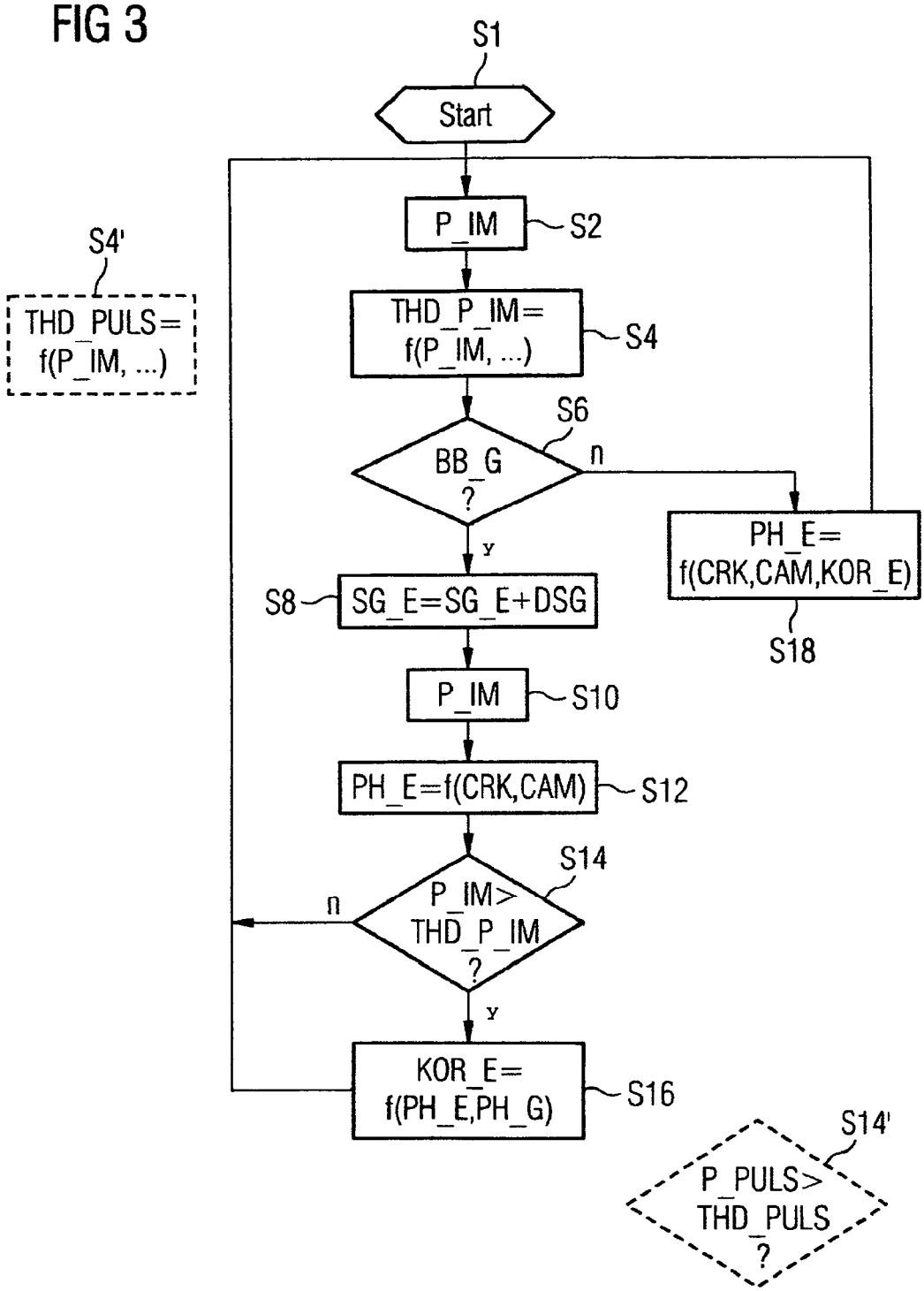
FIG. 3 shows a flow diagram of a first program for determining a determined phase.

A program for determining the phase of the internal combustion engine is stored in a program memory of the control device 25 and can be processed during operation of the internal combustion engine. Such a program is started in a step S1 (FIG. 3). Variables can optionally be initialized in the step S1.

In a step S2 the intake pipe pressure P_IM is detected. In a step S4 an intake pipe pressure threshold value is determined preferably as a function of the intake pipe pressure P_IM and optionally further operating variables of the internal combustion engine. Operating variables of the internal combustion engine include measured variables and also variables derived therefrom. The intake pipe pressure threshold value is preferably determined by means of a corresponding characteristic curve or set of characteristics, determined beforehand by tests on an engine test bed or by simulations. In one simple embodiment, the intake pipe pressure threshold value TDH_P_IM can also be set permanently beforehand.

In a step S6 it is verified whether predetermined operating conditions BB_G are present. The predetermined operating conditions can for example include a largely stationary operating state and/or an operating state BZ_NF without fuel being fed in, e.g. a thrust mode of the internal combustion engine, in which no fuel is fed into the cylinders Z1 to Z4 through the injection valves 22. The predetermined operating conditions BB_G are preferably selected such that any adjustment of the phase of the first camshaft 18 where possible has an insignificant impact on the running of the internal combustion engine and thus in particular on the torque generated by it and optionally the pollutant emissions it produces.

It can also be advantageous if the predetermined operating conditions BB_G also include temporal conditions or conditions that are a function of drive distance. These can for example comprise the fact that the condition of step S6 is only satisfied so often that one correction value KOR_E of the phase of the first camshaft is only determined once per engine run or within another time interval or even within a predetermined drive distance of a vehicle, in which the internal combustion engine is disposed.

If the condition of step S6 is satisfied, in a step S8 an actuating signal SG_E is increased by an incrementation value D_SG for the phase adjusting device 20. Alternatively the actuating signal SG_E can be correspondingly reduced for the phase adjusting device 20. The phase adjusting device 20 is then activated based on this modified actuating signal SG_E. The intake pipe pressure P_IM is then detected once again in a step S10. To this end a number of individual measured values of the intake pipe pressure are preferably detected and averaged.

In a step S12 the determined phase PH_E of the first camshaft 18 is then determined as a function of the crankshaft angle CRK and camshaft angle CAM detected after implementation of the step S8.

It is then verified in a step S14 whether the intake pipe pressure P_IM detected in the step S10 is greater than the intake pipe pressure threshold value THD_P_IM. It is appropriate for the intake pipe pressure threshold value THD_P_IM to be predetermined such that, if it is exceeded, in step S14 there is a reflux of gas from the outlet zone into the intake zone. If the condition of step S14 is not satisfied, processing continues in step S2. In an optionally alternative embodiment is can also continue directly in step S6.

If however the condition of step S14 is satisfied, in a step S16 the correction value KOR_E of the phase of the first camshaft 18 is determined as a function of the determined phase PH_E of the first camshaft 18 and a default phase PH_G. The default phase is stored in a data memory of the control device 25 and is the essentially correct value of an actual phase of the first camshaft 18, when the reflux due to the adjustment of the phase just starts to occur or can just be identified based on the procedure of steps S6 to S14. The default phase PH_G is determined beforehand by means of corresponding calculations, simulations or tests on an engine test bed.

The correction value KOR_E of the phase of the first camshaft 18 is determined in step S16 by means of a suitable formula. Thus in a particularly simple embodiment it can be determined directly as a function of the difference between the determined phase PH_E and the default phase PH_G. The formula can however also include any weighting of the difference between the determined phase PH_E and the default phase PH_G or can even incorporate a correction value KOR_E of the phase of the first camshaft 18 determined in step S16 during a previous run through the program. After step S16 the program preferably continues in step S2. Alternatively however it can continue directly in a step S18.

If the condition of step S6 is not satisfied, in step S18 the phase PH_E of the first camshaft 18 is determined as a function of the crankshaft angle CRK, the camshaft angle CAM and the correction value KOR_E. In this manner the phase of the first camshaft can thus be determined very accurately in each instance in step S18 by means of the determined phase PH_E, thus ensuring precise control of the internal combustion engine. Step 18 is preferably processed again during operation of the internal combustion engine at predetermined time intervals or in each instance after the passage of a predeterminable crankshaft angle CRK, at least if the predetermined operating conditions BB_G of step S6 are not present.

As an alternative or addition to step S4, a step S4' can be provided, in which a pulsation threshold value THD_PULS is determined, preferably also as a function of the intake pipe pressure P_IM and/or further operating variables of the internal combustion engine. The pulsation threshold value THD_PULS can however also be set permanently beforehand. As an alternative or addition a step S14' can then be provided, in which it is verified whether an amplitude P_PULS of the pulsation of the intake pipe pressure P_IM is greater than the pulsation threshold value THD_PULS. The pulsation amplitude P_PULS is preferably determined by corresponding evaluation of a number of individual measured values of the intake pipe pressure P_IM detected in step S10. The pulsation threshold value THD_PULS is preferably selected in an appropriate manner such that, if it is exceeded, there is a reflux of gas from the outlet zone into the intake zone. According to step S14, if the condition of step S14' is satisfied, step S16 is processed and, if said condition is not satisfied, step S2 or S6 is processed. The conditions of steps S14 and S14' can also be verified in an appropriate combination.

Figure 4:
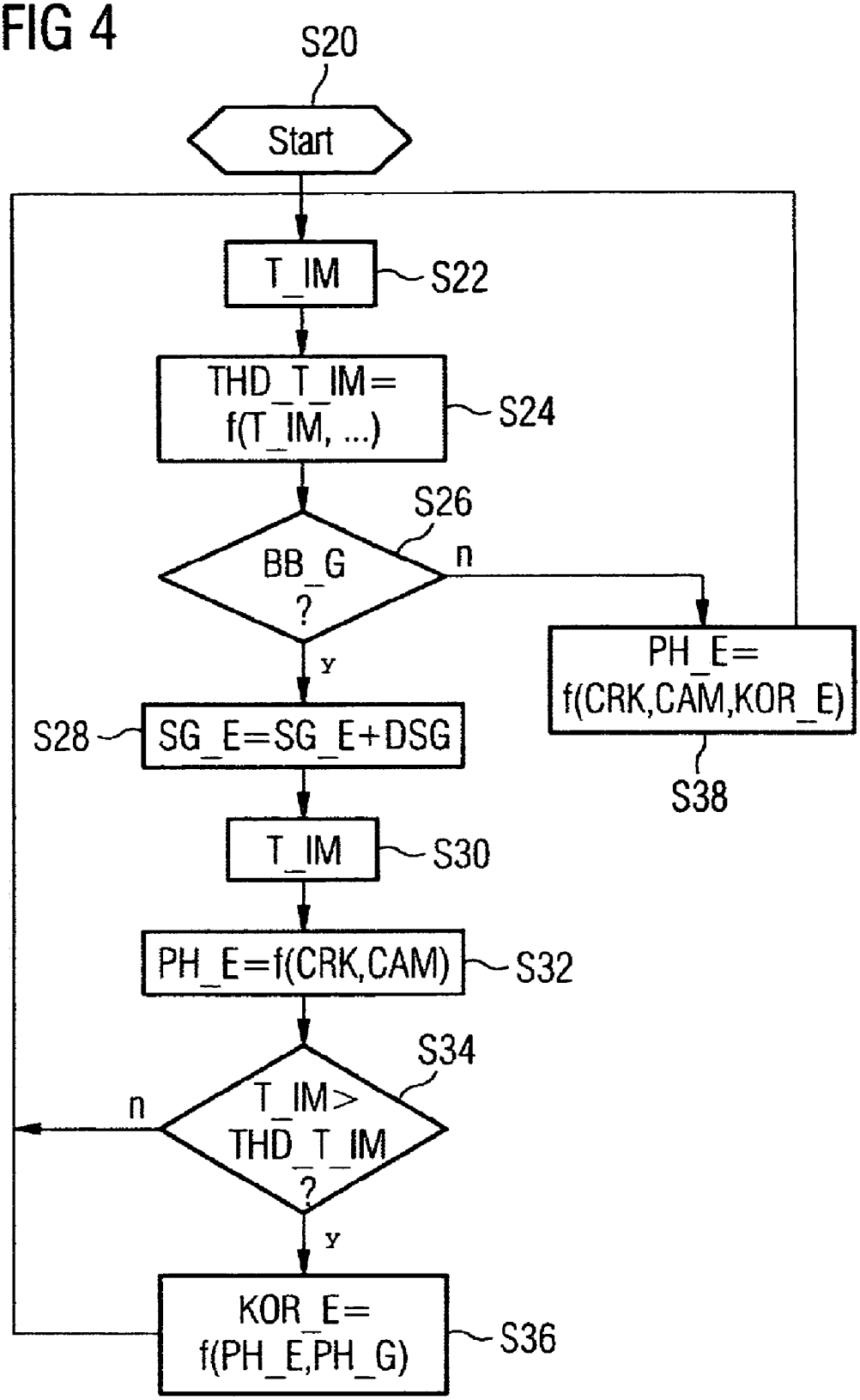
FIG. 4 shows a flow diagram of a second program for determining the determined phase and FIG. 5 shows a flow diagram of a third program for determining the determined phase.
Figure 5:
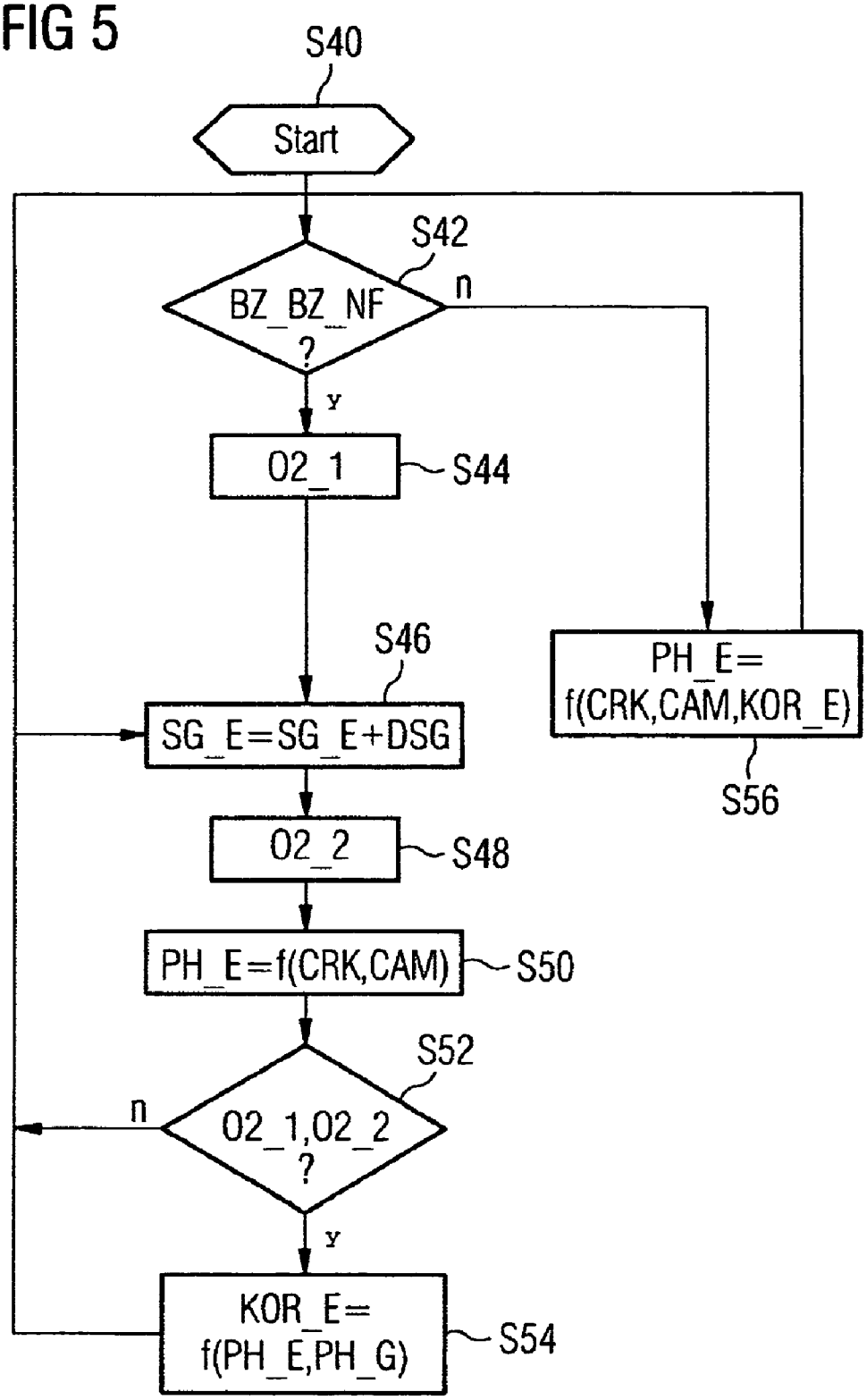

A second program for determining the phase of the internal combustion engine is started in a step S20 (FIG. 4), in which variables are optionally initialized. The second program and a third program to be described in more detail below with reference to FIG. 5 can be executed as an alternative to the first program or even as supplements to each other or in combination with each other. The differences compared with the steps of the first program are essentially described below.

In a step S22 the temperature T_IM of the gas in the intake zone 1 is determined. In a step S24 a temperature threshold value THD_T_IM is then determined as in step S4. In a step S26 it is verified according to step S6 whether the predetermined operating conditions BB_G are present. If the condition of step S26 is not satisfied, a step S38 is processed, which corresponds to step S18. If however the condition of step S26 is satisfied, a step S28 is processed, which corresponds to step S8. The temperature T_IM of the gas in the intake zone 1 is then determined in a step S30. This can take place as in step S10. A step S32 corresponds to a step S12. In a step S34 it is verified, as in step S14, whether the temperature T_IM of the gas in the intake zone is greater than the temperature threshold value THD_T_IM. If the condition of step S34 is not satisfied, processing continues according to step S14 either in step S22 or in step S26. If however the condition of step S34 is satisfied, a step S36 is processed, which corresponds to step S16.

With the third program (FIG. 5) a start takes place in a step S40. In a step S42 it is verified whether the operating state BZ corresponds to an operating state without fuel being fed in BZ_NF and optionally a redetermination of the correction value KOR_E is required due to the passage of time or drive distance conditions. The condition of step S42 is preferably verified so frequently that it is satisfied in each instance for the first time an appropriately short time after the start of assumption of the operating state BZ_NF without fuel being fed in. It is preferably then satisfied for the first time, when an oxygen content O2 determined in the next step S44 is representative of the absence of exhaust gas in the region of the gas type sensor 42. After the feeding in of fuel through the injection valves 22 has been deactivated, there is no further combustion in the respective cylinders Z1 to Z4 of the internal combustion engine and fresh air is pumped from the intake zone into the outlet zone. Depending on the reaction time of the gas type sensor, an oxygen content O2_1 is then detected by the gas type sensor 22, which is representative of the absence of exhaust gases in the region of the gas type sensor 42. This oxygen content O2_1 is detected in a step S44 by the gas type sensor 42.

In a step S46 the actuating signal SG_E for the phase adjusting device 20 is then modified according to step S8. In a step S48 a further oxygen content O2_2 is again detected by the gas type sensor 42. In a step S50 the determined phase is then determined according to step S12.

In a step S52 it is then verified whether the first oxygen content O2_1 is representative of the absence of exhaust gases in the region of the gas type sensor 42 and the second oxygen content O2_2 is representative of the presence of exhaust gases in the region of the gas type sensor. If the condition of step S52 is not satisfied, processing preferably continues directly again in step S46. If however the condition of step S52 is satisfied, in a step S54 the correction value KOR_E for the phase of the first crankshaft 18 is determined according to the procedure of step S16. With an appropriately short sequence of the repeated processing of steps S46 to S52, it is possible to ensure that, when the reflux of gases or gas from the outlet zone 4 to the intake zone 1 occurs due to the adjustment of the phase, there is still exhaust gas in the outlet zone and this is then taken back into the region, in which the gas type sensor 42 is disposed.

The default phase PH_G is then determined in an appropriate manner by tests, calculations or simulations, in order to represent the actual phase of the first camshaft 18 when the condition of step S52 starts to be satisfied.

To determine the correction value KOR_E, the steps and in particular the conditions of the steps S14; S34 and S52 can be combined in any way with each other. If as an alternative the phase adjusting device 20 is assigned only to the second camshaft, corresponding programs can be provided for the second camshaft. If corresponding phase adjusting devices 20 are assigned to both the first and the second camshafts, specific correction values are preferably determined for each of the camshafts 18, 18' by means of corresponding programs. To this end the phase adjusting device assigned to the respective other camshaft 18, 18' is preferably in a reference position in each instance, for example at a mechanical stop.

The invention claimed is:

1. A method for determining a phase of an internal combustion engine, comprising:
   - determining an initial phase angle of a camshaft of the engine;
   - adjusting the phase angle of the camshaft by a phase adjusting device;
   - identifying a reflux of gas from an outlet zone into an intake zone of the engine;
   - terminating the camshaft adjustment once exhaust gas reflux has been identified;
   - determining the adjusted phase angle of the camshaft;
   - determining a correction value of the phase angle as a function of the initial phase angle and the adjusted phase angle; and
   - correcting the adjusted phase angle by the correction value for subsequent engine operation.

2. The method as claimed in claim 1, wherein the reflux of gas is identified as a function of an intake pipe pressure.

3. The method as claimed in claim 2, wherein the reflux of gas is identified when an intake pipe pressure exceeds a predetermined intake pipe pressure value associated with a predetermined operating condition of the engine.

4. The method as claimed in claim 3, wherein the reflux of gas is identified when an amplitude of a position of the intake pipe pressure exceeds a predetermined pulsation threshold value.

5. The method as claimed in claim 1, wherein the reflux of gas is identified as a function of an intake zone gas temperature.

6. The method as claimed in claim 5, wherein the reflux of gas is identified when the temperature of the gas in the intake zone exceeds a predetermined temperature value.

7. The method as claimed in claim 1, wherein the reflux of gas is identified as a function of a temperature of the outlet zone gas when the detected temperature of the outlet zone gas changes from a determined value representative of the absence of exhaust gases to a second determined value representative of the presence of exhaust gases during an operating state of the internal combustion engine when fuel is not fed in.

8. The method as claimed in claim 7, wherein the reflux of gas is identified when the temperature of the outlet zone gas exceeds a predetermined second temperature value.

9. The method as claimed in claim 8, wherein a gas type sensor is provided in the exhaust gas zone that produces a measurement signal representative of the presence or absence of exhaust gases in the region of the gas type sensor.

10. A device for determining a phase of an internal combustion engine having an intake zone, and outlet zone, a crankshaft, a camshaft and gas exchange valves actuated by the camshaft, comprising:
   - a camshaft phase angle sensor that determines a phase angle of the camshaft relative to the crankshaft position and outputs a determined phase angle;
   - a camshaft phase angle adjusting device that adjusts the phase angle of the camshaft relative to the crankshaft;

a controller connected to the phase angle sensor and phase angle adjusting device that:

receives the determined phase angle from the phase angle sensor, activates the phase angle adjusting device until a reflux of gas from the outlet zone into the intake zone is identified, determines a phase angle correction value as a function of the determined phase and a predetermined default phase angle, and corrects the determined phase angle as a function of the correction value for subsequent operation of the engine.

11. A method for determining a phase of an internal combustion engine, comprising:

determining an initial phase angle of a camshaft of the engine;

adjusting the phase angle of the camshaft by a phase adjusting device;

identifying a reflux of gas from an outlet zone into an intake zone of the engine; and terminating the camshaft adjustment once exhaust gas reflux has been identified.

12. The method as claimed in claim 11, further comprising determining the adjusted phase angle of the camshaft.

13. The method as claimed in claim 12, further comprising determining a correction value of the phase angle as a function of the initial phase angle and the adjusted phase angle.

14. The method as claimed in claim 13, further comprising correcting the adjusted phase angle by the correction value for subsequent engine operation.

* * * * *